US008256806B2

(12) United States Patent
Timothy

(10) Patent No.: US 8,256,806 B2
(45) Date of Patent: Sep. 4, 2012

(54) DUAL CAM MAGNETIC LATCH SYSTEM

(75) Inventor: E. Erik Timothy, Apollo Beach, FL (US)

(73) Assignee: Nationwide Industries, Inc., Tampa, FL (US)

( * ) Notice: Subject to any disclaimer, the term of this patent is extended or adjusted under 35 U.S.C. 154(b) by 9 days.

(21) Appl. No.: 12/410,060

(22) Filed: Mar. 24, 2009

(65) Prior Publication Data

US 2010/0244463 A1 Sep. 30, 2010

(51) Int. Cl.
*E05C 17/56* (2006.01)

(52) U.S. Cl. ..... 292/251.5; 292/341.15; 292/DIG. 29

(58) Field of Classification Search ..... 292/251.5, 292/254, 341.15, DIG. 29
See application file for complete search history.

(56) References Cited

U.S. PATENT DOCUMENTS

| | | | | |
|---|---|---|---|---|
| 7,044,511 | B2 * | 5/2006 | Kliefoth et al. | 292/251.5 |
| 7,390,035 | B2 * | 6/2008 | Karcz et al. | 292/163 |
| 2005/0062296 | A1 * | 3/2005 | Lyon | 292/251.5 |
| 2008/0296915 | A1 * | 12/2008 | Clark et al. | 292/251.5 |
| 2009/0273194 | A1 * | 11/2009 | Patterson | 292/251.5 |

* cited by examiner

*Primary Examiner* — Carlos Lugo
*Assistant Examiner* — Mark Williams
(74) *Attorney, Agent, or Firm* — George R. McGuire; Blaine T. Bettinger; Bond Schoeneck & King

(57) ABSTRACT

A magnetic latch system including a latch assembly and a keeper assembly. The keeper assembly includes a magnetically attractable keeper pin. The latch assembly includes two base assemblies, one on either side of a movable gate element. The base assembly adjacent the keeper assembly includes a magnet and an internal actuator which is arranged to engage the keeper pin to move it away from the permanent magnet when one of the latch handles is manually rotated. The system may also include a locking system in one or both handles to fix the internal actuator in a locked position so that it cannot engage the keeper pin.

5 Claims, 10 Drawing Sheets

DUAL CAM MAGNETIC LATCH SYSTEM

BACKGROUND OF THE INVENTION

1. Field of the Invention

The present invention relates to a magnetic latch, and, more specifically, a magnetic latch system useful for latching a gate to a fence post.

2. Description of the Related Art

Many types of gate latches have previously been used to secure different varieties of gates. Some gate latch mechanisms have used manual latches, magnetic latches, and other forms of latches. Prior art gates have not, however, employed a dual cam locking system to allow the user to open and lock or unlock the mechanism from either side of the gate.

BRIEF SUMMARY OF THE INVENTION

In view of the foregoing, it should be apparent that a need still exists in the prior art for a locking device that avoids the problems inherent in the prior art systems. Accordingly, it is a primary object of the present invention to provide an improved magnetic lock assembly which uses a dual cam system to allow the user to open and lock or unlock the mechanism from either side of the gate.

Another object of the invention is to provide a magnetic latch system adapted to secure a movable gate element relative to a fixed post element. The magnetic latch system includes a latch adapted for mounting on the gate element and a keeper assembly adapted for mounting on a relatively fixed post element. The keeper assembly includes a keeper base, a keeper housing mounted on the keeper base, a magnetically attractable keeper pin movably mounted on the keeper housing, and a coil spring for biasing the keeper pin in a substantially retracted position within the keeper housing. The first base of the latch assembly is mountable on the movable gate element and includes a rotatably mounted spindle, a handle mounted on the spindle for manual rotation, an internal actuator mounted on the spindle for rotation therewith, and a permanent magnet. The first base is adapted to be cooperatively arranged with the keeper assembly so that the permanent magnet attracts the keeper pin in a substantially extended position toward the first base when the keeper pin is adjacent to the permanent magnet. The internal actuator is arranged to engage the keeper pin and move it toward the keeper assembly away from the magnetic attraction between the keeper pin and the permanent magnet. The internal actuator is movable into a position where the keeper pin engages the base in a substantially extended position and disengages from the base when the keeper pin is moved by the actuator. The latch assembly further includes a second base mountable on the movable gate, the spindle mounted on the second base, and a second handle mounted on the spindle for manual rotation. The first and second bases are adapted to be cooperatively arranged with the moveable gate and the spindle so that the spindle rotatably traverses through the moveable gate.

According to another aspect of the present invention, the latch assembly further includes a second spindle mounted to the first base, a cylinder assembly mounted on the first base and in communication with the second spindle, and a protruding member in movable communication with the cylinder assembly so that the protruding member is arranged to engage a cavity defined in the base, thereby preventing rotation of the internal actuator. The protruding member is also movable to substantially disengage the cavity when the cylinder assembly is rotated, thereby allowing rotation of the internal actuator.

According to yet another aspect of the present invention, the second spindle is mounted to the second base. The second base also includes a second cylinder assembly which is in communication with the second spindle.

According to yet another aspect of the present invention, the second spindle is disposed through a cavity defined lengthwise in the center of the first spindle.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
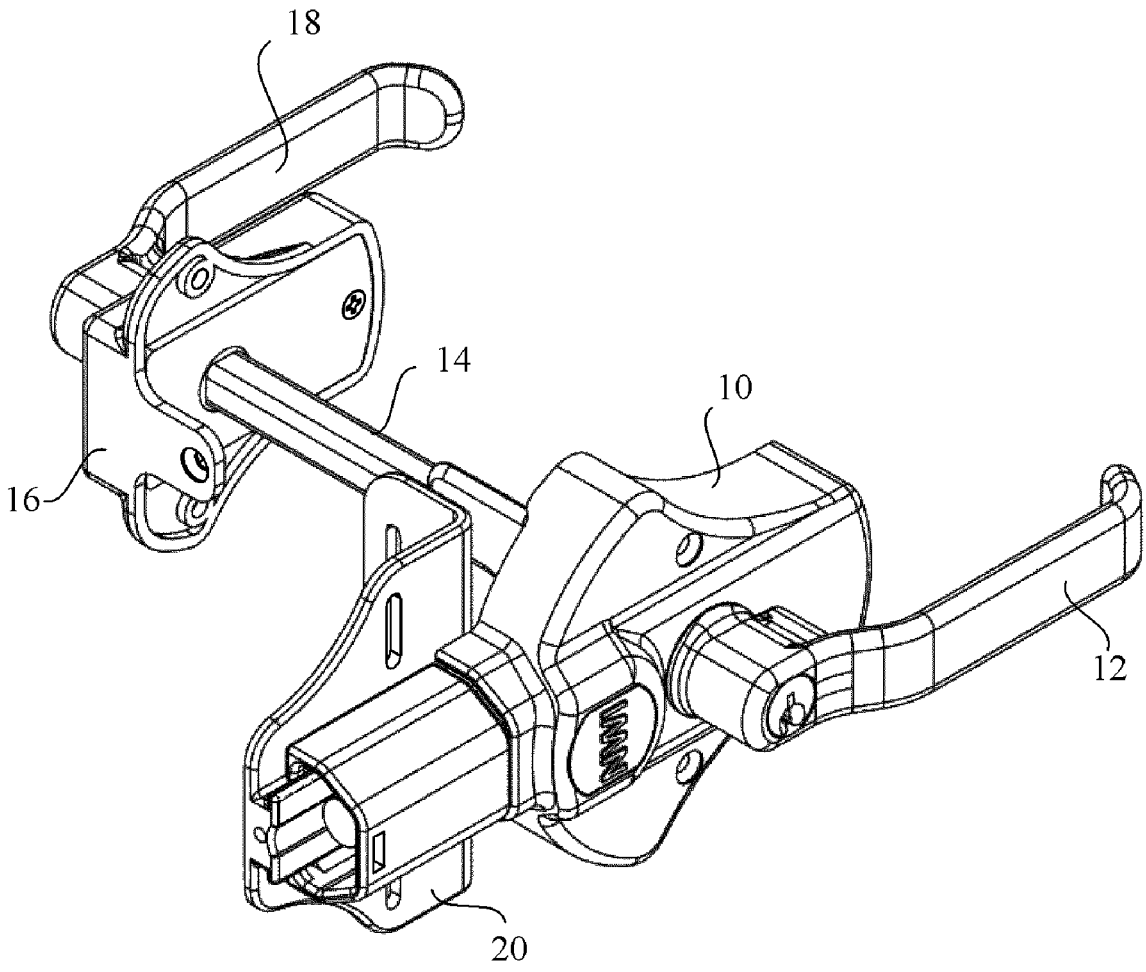
FIG. 1 is an overall perspective view of one embodiment of the magnetic latch system.

Referring now to the drawings, wherein like reference numerals refer to like parts throughout, there is seen in FIG. 1 an overall perspective view of one embodiment of the magnetic latch system. The side A latch assembly 10 with side A handle assembly 12 is mounted to one side of the gate post and is in communication with the side B latch assembly 16 with side B handle assembly 18 via handle spindle 14. Handle spindle 14 is designed to traverse through the gate post to which latch assembly 10 and 16 are mounted. Adjacent to side A latch assembly 10 is the keeper assembly 20 which is mounted to the fence post. FIG. 1 shows the magnetic latch assembly in the closed and latched configuration.

Figure 2:
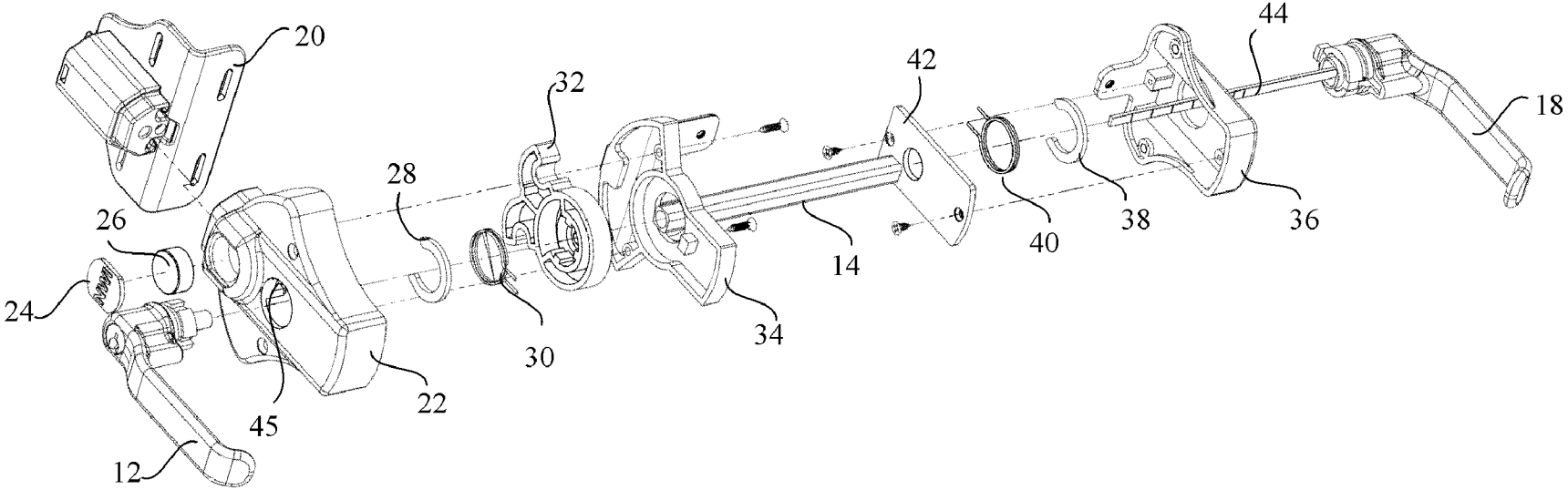
FIG. 2 is an exploded view of the latch assembly of FIG. 1.

FIG. 2 an exploded view of side A latch assembly 10 and side B latch assembly 16 of FIG. 1. Side A handle assembly 12 and side B handle assembly 18 are mounted on either end of the latch assembly. Handle spindle 14 is mounted: (i) through side A latch assembly 10 including the side A latch assembly housing 22, the handle clip 28, the handle spring 30, the cam actuator 32, and the side A housing back cover 34; (ii) then through the gate post (not shown); (iii) then through side B latch assembly 16 including the side B latch housing back plate 42, the handle spring 40, the handle clip 38, and the side B latch assembly housing 36. Side A latch assembly housing 22 contains the magnet 26 covered by the magnet cap 24. Side B handle assembly 18 is affixed to long spindle 44 which inserts into the interior of handle spindle 14.

Figure 3:
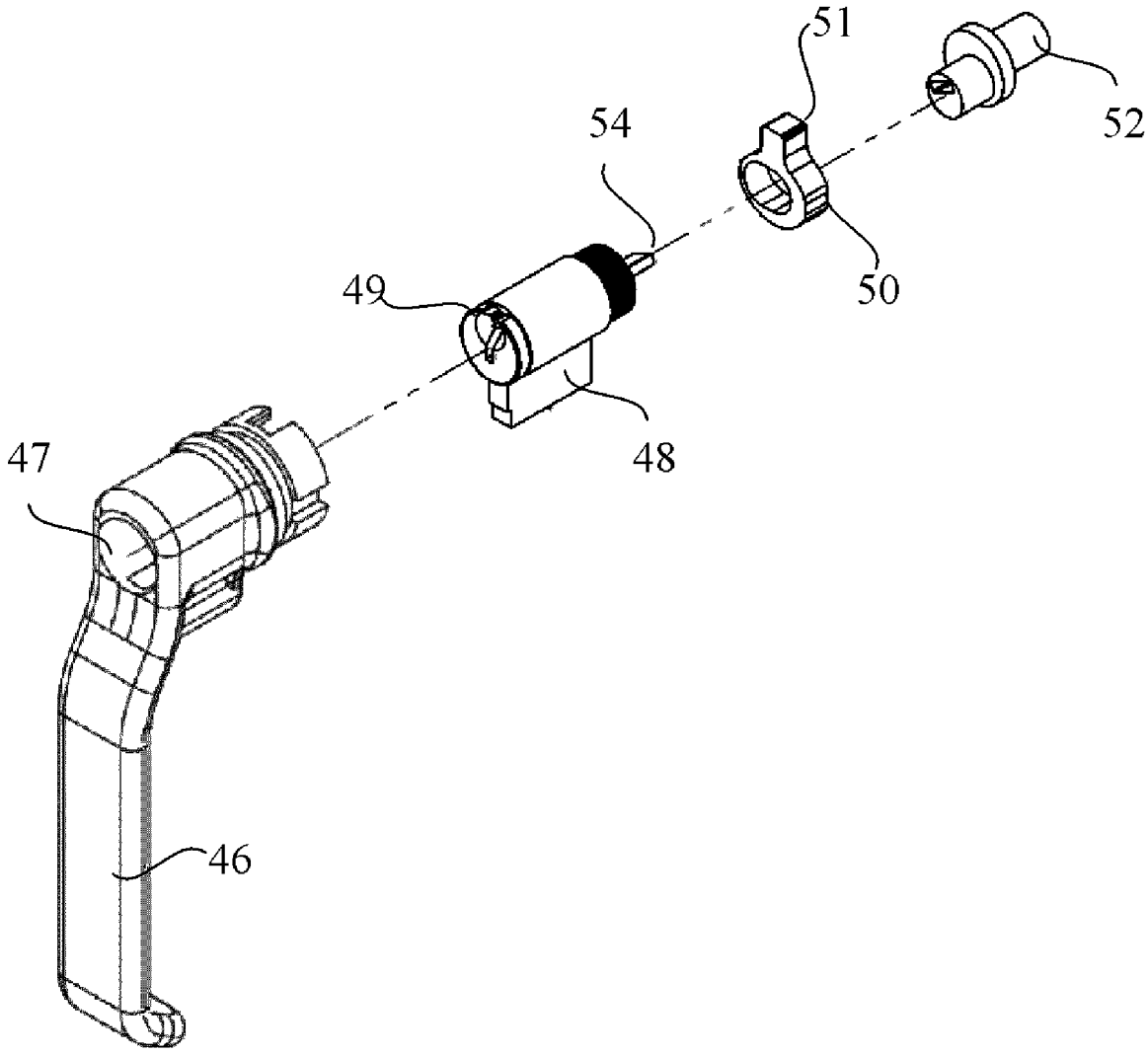
FIG. 3 is an exploded view of the side A handle assembly according to one embodiment of the present invention.

FIG. 3 is an exploded view of side A handle assembly 12 according to one embodiment of the present invention.

Figure 6:
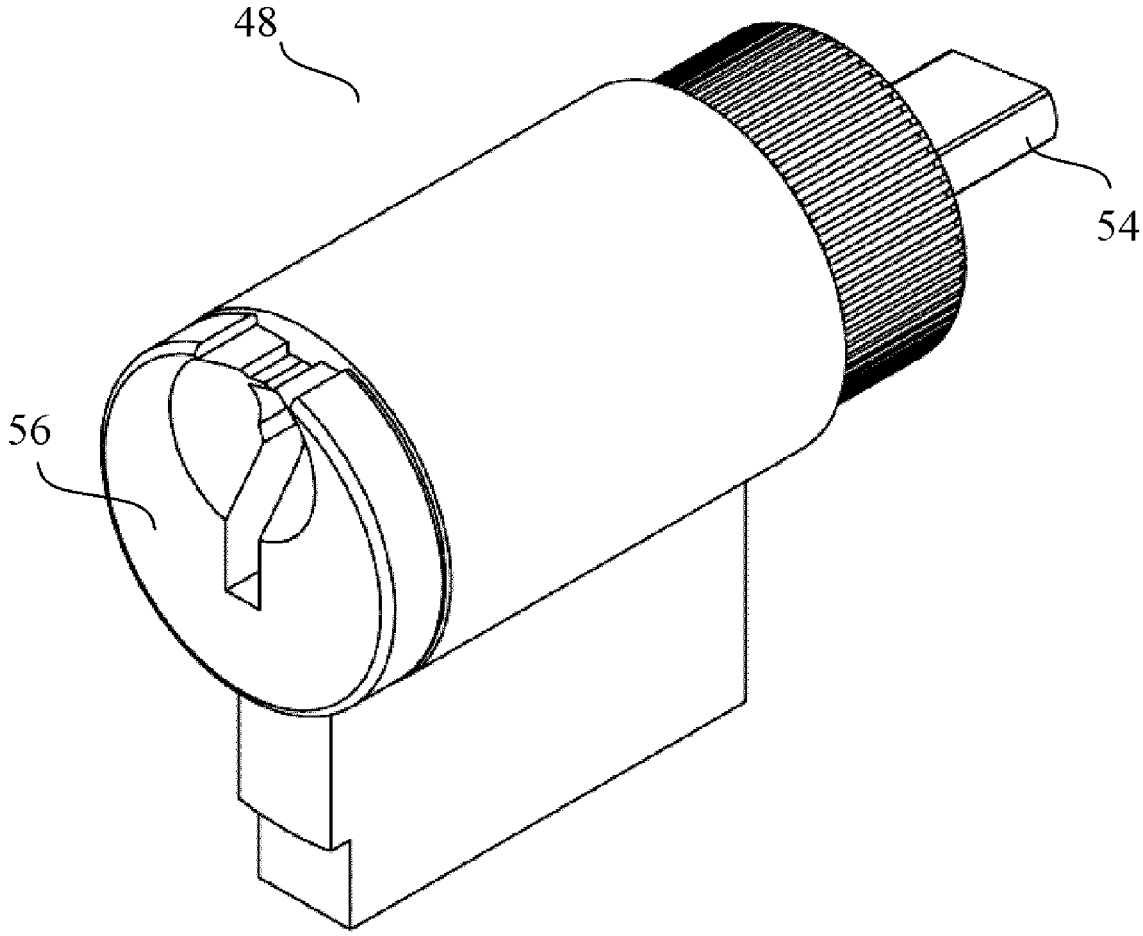
FIG. 6 is a side view of the side A key cylinder assembly used in the side A handle assembly of FIG. 3.

Housed within handle 46 is the side A key cylinder assembly 48 with short spindle 54, the cam follower 50, and the side A cam 52. As shown in FIG. 6, key cylinder assembly 48 has opening 56 for a key and short spindle 54, which engages side A cam 52.

Figure 9:
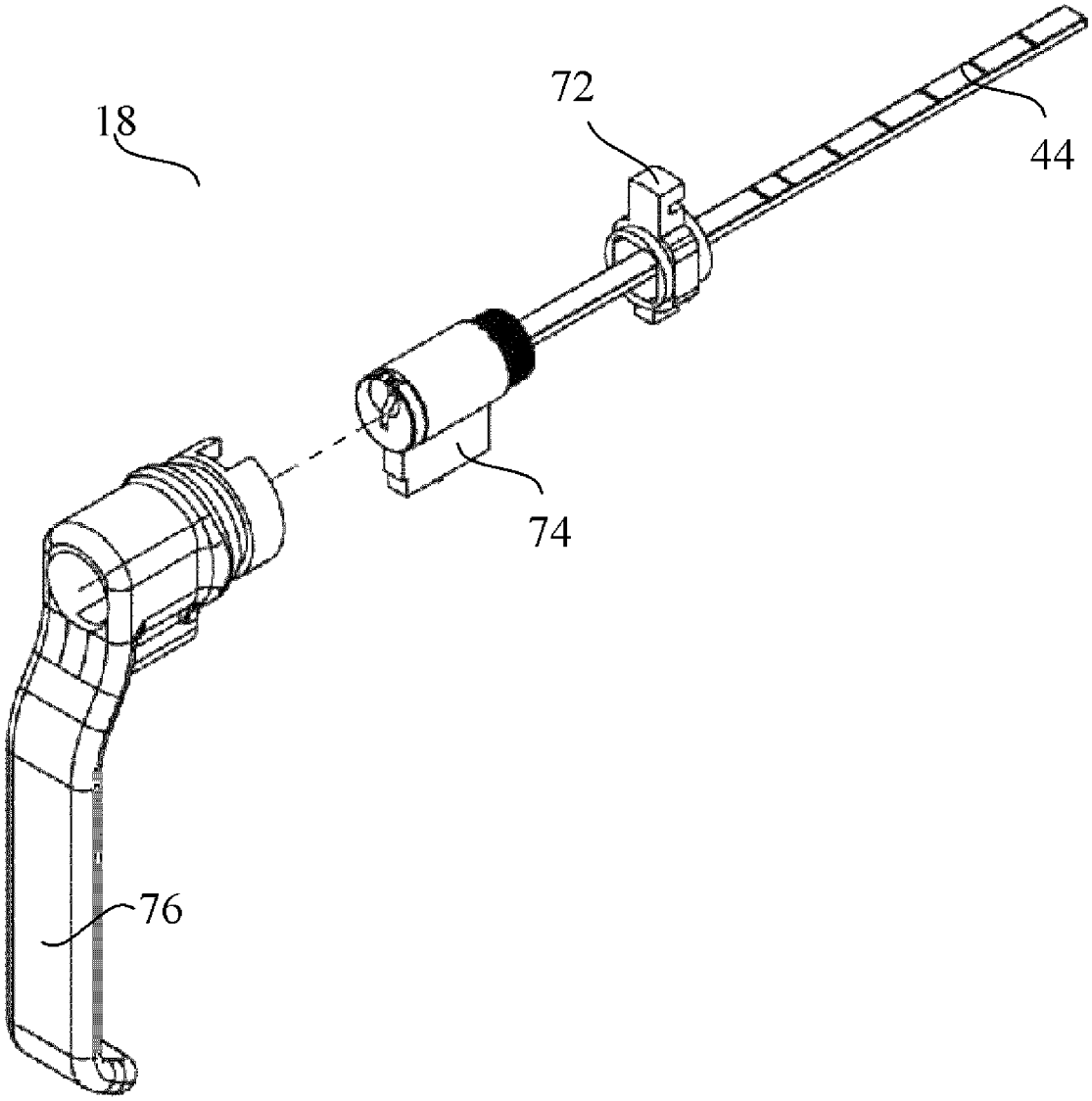
FIG. 9 is an exploded view of the side B handle assembly according to one embodiment of the present invention.

FIG. 3 also shows a front face 49 of key cylinder assembly 48 which is mounted into handle 46 of side A handle assembly 12 such that front face 49 is accessible to a user through an opening 47 in the handle. FIG. 9 shows the same configuration for side B handle assembly 18.

Figure 4:
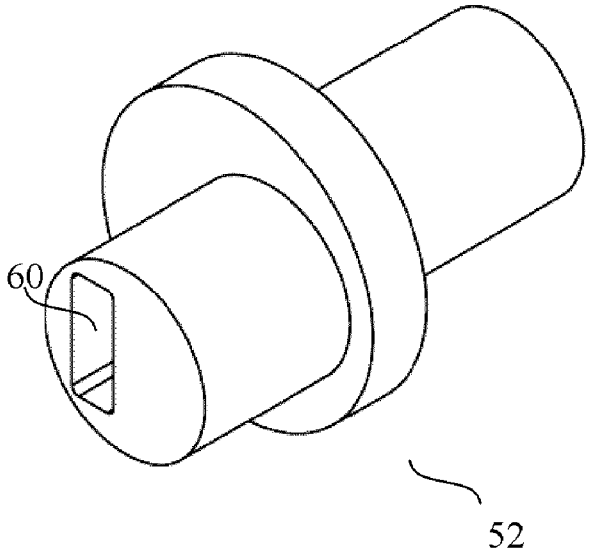
FIG. 4 is a side view of the cam used in the side A handle assembly of FIG. 3.
Figure 5:
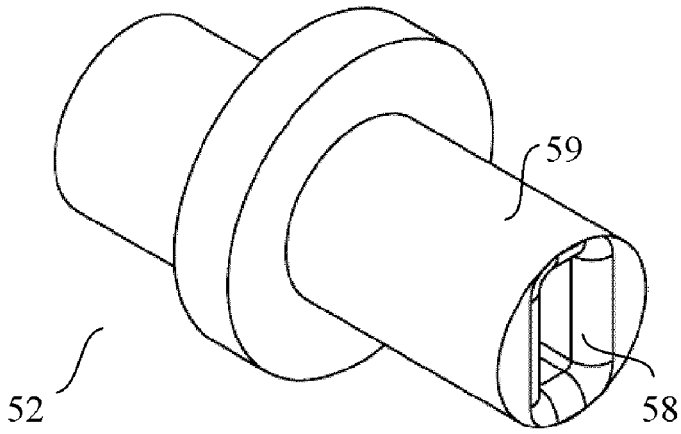
FIG. 5 is a reverse side view of the cam used in the side A handle assembly of FIG. 3.

FIGS. 4 and 5 show the front and reverse sides, respectively, of side A cam 52. The reverse side of cam 52 contains an opening 58 to engage the end of long spindle 44. The front side of cam 52 contains an opening 60 to engage short spindle 54 of key cylinder assembly 48, and handle spindle 14 slides over arm 59 of cam 52. Cam 52 and cam follower 50 allow key cylinder assembly 48 to lock and unlock handles 46 and 76 from manual rotation.

Figure 7:
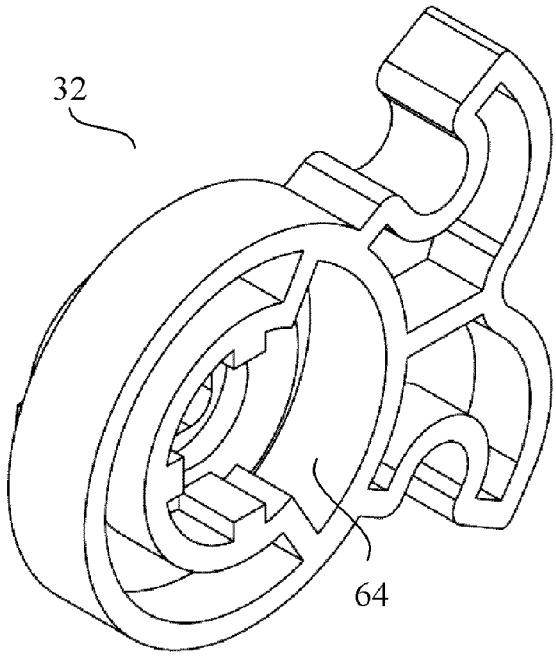
FIG. 7 is a side view of the cam actuator used in the side A latch assembly.
Figure 8:
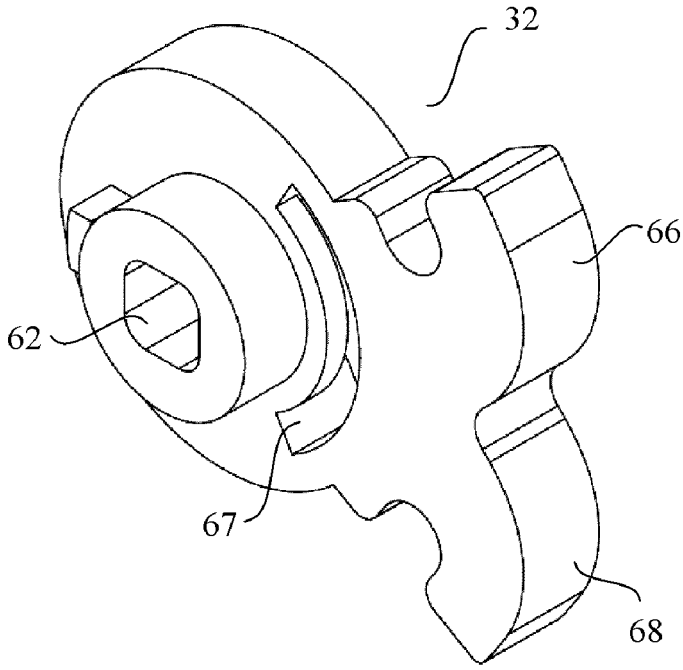
FIG. 8 is a reverse side view of the cam actuator used in the side A latch assembly.

Cam actuator 32 is depicted in FIGS. 7 and 8. The cam actuator contains an opening 62 for handle spindle 14 and the cam actuator pocket 64 which interacts with side A handle assembly 12. The actuator also possesses two arms with rounded outer surfaces 66 and 68. These surfaces reversibly interact with the keeper pin 70 when cam actuator 32 is rotated either clockwise or counterclockwise within handle assembly 12 via manual rotation of handle spindle 14.

FIG. 9 is an exploded view of side B handle assembly 18 according to one embodiment of the present invention. Housed within handle 76 is the side B key cylinder assembly 74 and handle cam 72. Extending from cylinder assembly 74 is long spindle 44 which is freely inserted into the interior of handle spindle 14. Handle cam 72 allows key cylinder assembly 74 to lock and unlock handles 46 and 76 from manual rotation.

Figure 10:
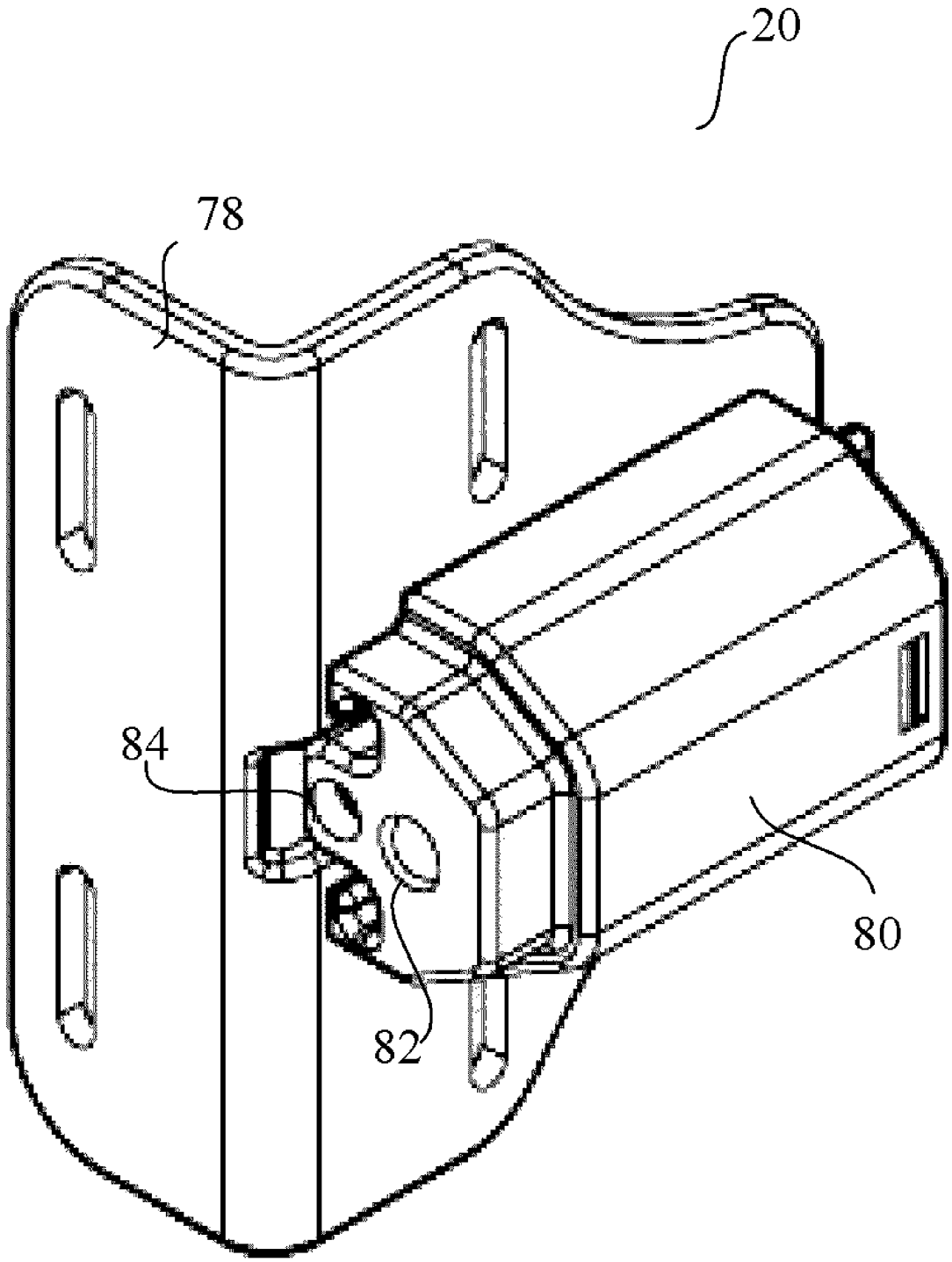
FIG. 10 is a side view of the keeper assembly according to one embodiment of the present invention.

FIG. 10 is a side view of the keeper assembly according to one embodiment of the present invention. The keeper base 78 is removably affixed to the fence post (not shown). The keeper slide 80 is reversibly attached to keeper base 78.

Figure 11:
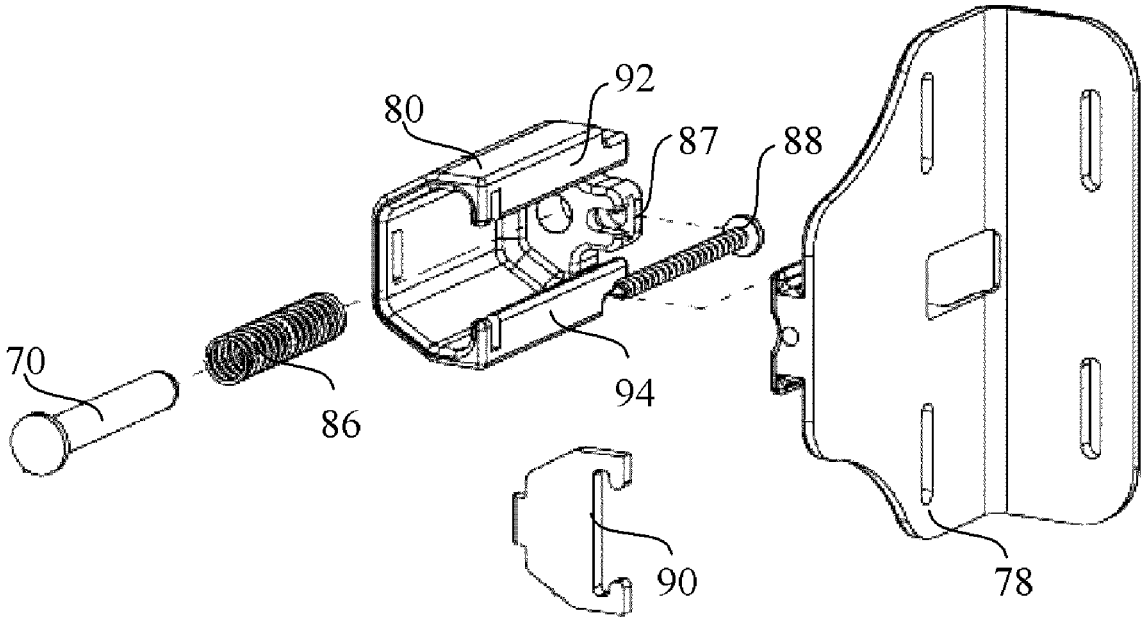
FIG. 11 is an exploded view of the keeper assembly of FIG. 10.
Figure 12:
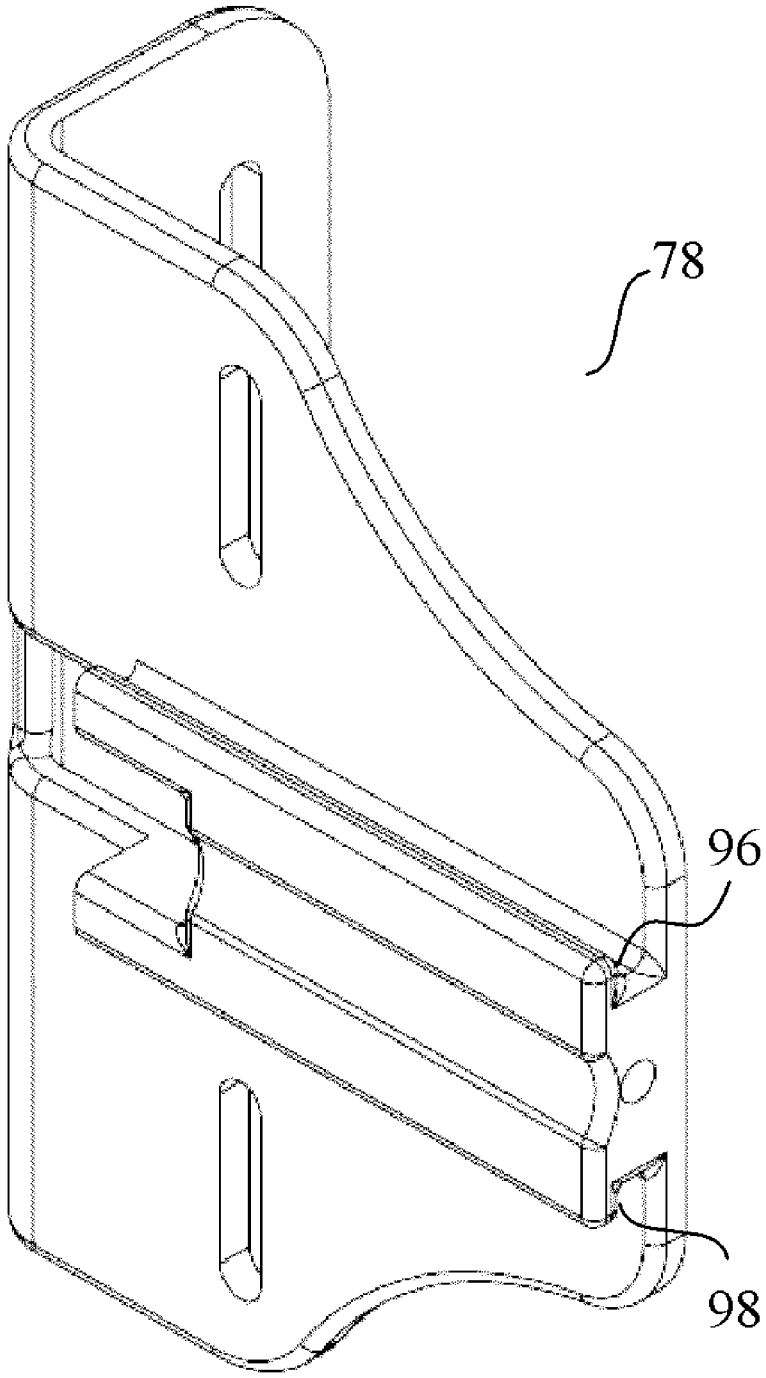
FIG. 12 is a side view of the keeper assembly base.

FIG. 11 is an exploded view of the keeper assembly of FIG. 10. A pin spring 86 fits over keeper pin 70 and biases the pin in a retracted position inside slide 80. The keeper back plate 90 affixes to slide 80 to safely enclose keeper pin 70 within the assembly. Keeper slide 80 has arms 92 and 94 which firmly slide into grooves 96 and 98 on keeper base 78, respectively, as shown in FIG. 12. To removably connect slide 80 to keeper base 78, a screw 88 is inserted into a cavity 87 defined in slide 80. Slide arms 92 and 94 are then firmly placed into grooves 96 and 98. At the same time, screw 88 inserts into an orifice in keeper base 78 (not shown) and is accessed through an orifice 84 (shown in FIG. 10) in slide 80 to allow clockwise rotation of the screw which pushes the slide arms further along the grooves of the keeper base. In addition to reversibly joining slide 80 and keeper base 78, screw 88 allows for horizontal adjustment of the slide along the keeper base to compensate for variations in the gap between the fence post and the gate.

The latch can be locked or unlocked from either side of the latch assembly. Side A housing 22 contains a protruding member 45 (as shown in FIG. 2) that, when the latch is assembled, extends through cam actuator pocket 64 into a cam actuator cavity 67. Defined in protruding member 45 is a cavity (not shown) to receive the extending tab 51 of cam follower 50. When either side of the latch is locked, tab 51 of cam follower 40 extends into the cavity of protruding member 45 and prevents handle assembly 12 from rotating cam actuator 21, thus locking the gate. To unlock the gate using side A handle assembly 12, key cylinder assembly 48 is unlocked with a key, thus rotating short spindle 54 which in turn rotates cam 52. As cam 52 rotates, cam follower 50 moves in a horizontal plane to withdraw tab 51 from the cavity in protruding member 45 of side A housing 22. As a result, cam actuator 32 is no longer inhibited and can be rotated by manually rotating handle 46. Similarly, to unlock the gate using side B handle assembly 18, key cylinder assembly 74 is unlocked with a key, thus rotating long spindle 44 which in turn rotates cam 52.

The latch can be opened from either side of the latch assembly. When the latch assembly is unlocked and assembled as shown in FIG. 1, slide A handle assembly 12 is in communication with cam actuator 32. Rotating handle 46 clockwise causes the cam actuator to rotate clockwise within side A latch assembly 10. As cam actuator 32 rotates clockwise, rounded outer surface of arm 68 of the actuator pushes keeper pin 70 away from magnet 26, disrupting the magnetic interaction and allowing keeper pin 70 to retract from latch assembly 10 and return to its spring-bias in keeper assembly 20. Similarly, rotating handle 46 counterclockwise causes cam actuator 32 to rotate counterclockwise and forces the rounded outer surface of arm 66 of the actuator to push keeper pin 70 away from magnet 26. Once keeper pin 70 is retracted, the gate can be opened.

A similar process is used to open the gate using handle 76 of side B handle assembly 18. Rotating handle 76 clockwise causes handle cam 72 to turn, which in turn forces handle spindle 14 to rotate clockwise. As spindle 14 rotates, cam actuator 32 rotates clockwise and the keeper pin 70 is subsequently allowed to return to its spring-bias in the keeper assembly. If handle 76 is rotated counterclockwise, cam actuator 32 will rotate counterclockwise and keeper pin 70 will retract.

Although the present invention has been described in connection with a preferred embodiment, it should be understood that modifications, alterations, and additions can be made to the invention without departing from the scope of the invention as defined by the claims.

What is claimed is:

1. A magnetic latch system adapted to secure a movable gate relative to a fixed post, said system comprising a latch assembly for mounting on said gate and a keeper assembly adapted for mounting on said fixed post;

said keeper assembly comprising a keeper base, a keeper housing mounted on said keeper base, a magnetically attractable keeper pin movably mounted on said keeper housing, a coil spring for biasing said keeper pin in a substantially retracted position within said keeper housing;

said latch assembly comprising a first base mountable on said movable gate, a spindle rotatably mounted on said first base, a first handle mounted on said spindle for manual rotation of said spindle, an internal actuator mounted on said spindle for rotation therewith, a permanent magnet mounted on said first base;

said first base being adapted to be cooperatively arranged with said keeper assembly so that said permanent magnet attracts said keeper pin in a substantially extended position toward said first base when said keeper pin is adjacent said permanent magnet, said internal actuator being arranged to engage said keeper pin and move it toward said keeper assembly away from the magnetic attraction between said keeper pin and said permanent magnet;

said internal actuator being movable into a position where said keeper pin engages said first base in said substantially extended position and disengages from said first base when said keeper pin is moved by said actuator;

said latch assembly comprising a second base mountable on said movable gate, said spindle mounted on said second base, a second handle mounted on said spindle for manual rotation of said spindle, wherein said first base is arranged on a first side of said moveable gate and said second base is arranged on a second side of said moveable gate, said second side of said moveable gate opposite said first side of said moveable gate, and further wherein said spindle rotatably traverses between said first and second bases through a spindle cavity formed through said moveable gate;

said first base and said second base adapted to be cooperatively arranged with said moveable gate and said spindle so that said spindle rotatably traverses through a spindle cavity formed through said moveable gate, wherein said first and second spindles are the only direct communication between said first and second bases;

said first base further comprising a cam, a second spindle with first and second ends, wherein said second spindle is disposed through a cavity defined lengthwise in the center of said first spindle and the first end of said second spindle is in communication with said cam, a first cylinder assembly mounted on said first base and in communication with said cam, and a protruding member in movable communication with said first cylinder assembly so that said protruding member is arranged to engage a cavity defined in said base, thereby preventing rotation of said internal actuator; and said protruding member being movable to substantially disengage said cavity when said first cylinder assembly is rotated, thereby allowing rotation of said internal actuator.

2. The magnetic latch system of claim 1, said latch assembly further comprising:

said second end of said second spindle mounted to said second base, a second cylinder assembly mounted on said second base and in communication with said second spindle.

3. The magnetic latch system of claim 1, wherein said keeper housing is slidably mounted on said keeper base such that said housing is adjustable relative to said base.

4. The magnetic latch system of claim 1, wherein the length of said spindle and said second spindle is adjustable.

5. The magnetic latch system of claim 1, said latch assembly further comprising:

a second cylinder assembly mounted on said second base and in communication with said second spindle; wherein said protruding member is in movable communication with said second spindle so that said protruding member is arranged to engage a cavity defined in said base, thereby preventing rotation of said internal actuator;

said protruding member being movable to substantially disengage said cavity when said second cylinder assembly is rotated, thereby allowing rotation of said internal actuator.

* * * * *